United States Patent [19]

Ehrhart et al.

[11] Patent Number: 4,543,939

[45] Date of Patent: Oct. 1, 1985

[54] FUEL SUPPLY ASSEMBLY FOR MIXTURE-COMPRESSING INTERNAL COMBUSTION ENGINES AND ASSOCIATED METHODS OF OPERATION

[75] Inventors: Fritz Ehrhart; Asoke Chattopadhay; Karl Schmidt, all of Neuss, Fed. Rep. of Germany

[73] Assignee: Pierburg GmbH & Co. K.G., Neuss, Fed. Rep. of Germany

[21] Appl. No.: 569,457

[22] Filed: Jan. 9, 1984

[30] Foreign Application Priority Data

Jan. 20, 1983 [EP] European Pat. Off. ..... 83100469.2

[51] Int. Cl.[4] ..... F01B 25/08

[52] U.S. Cl. ..... 123/533; 123/531; 123/53 A

[58] Field of Search ..... 123/533, 531, 478, 53 A

[56] References Cited

U.S. PATENT DOCUMENTS

| | | | |
|---|---|---|---|
| 1,625,997 | 4/1927 | Grönkwist | 123/533 |
| 2,234,267 | 3/1941 | Mallory | 123/53 A |
| 2,415,506 | 2/1947 | Mallory | 123/53 A |
| 2,482,864 | 9/1949 | Neonnich | 123/533 |
| 4,418,673 | 12/1983 | Tominari et al. | 123/478 |
| 4,424,785 | 1/1984 | Isbida et al. | 123/478 |

*Primary Examiner*—Raymond A. Nelli

*Attorney, Agent, or Firm*—Roberts, Spiecens & Cohen

[57] ABSTRACT

A fuel supply assembly for a gasoline internal combustion engine in which the amount of fuel supplied is controlled by an electromagnetic injection valve which in turn is controlled by an electronic controller subjected to operating parameters. The assembly comprises a fuel metering device and a vane pump in which is supplied a branch stream of air tapped from an inlet duct upstream of the throttle valve. The fuel is introduced into the pump chamber downstream of the air and both the fuel and air are supplied to the pump chamber substantially tangentially to be mixed for the first time in the pump chamber.

16 Claims, 1 Drawing Figure

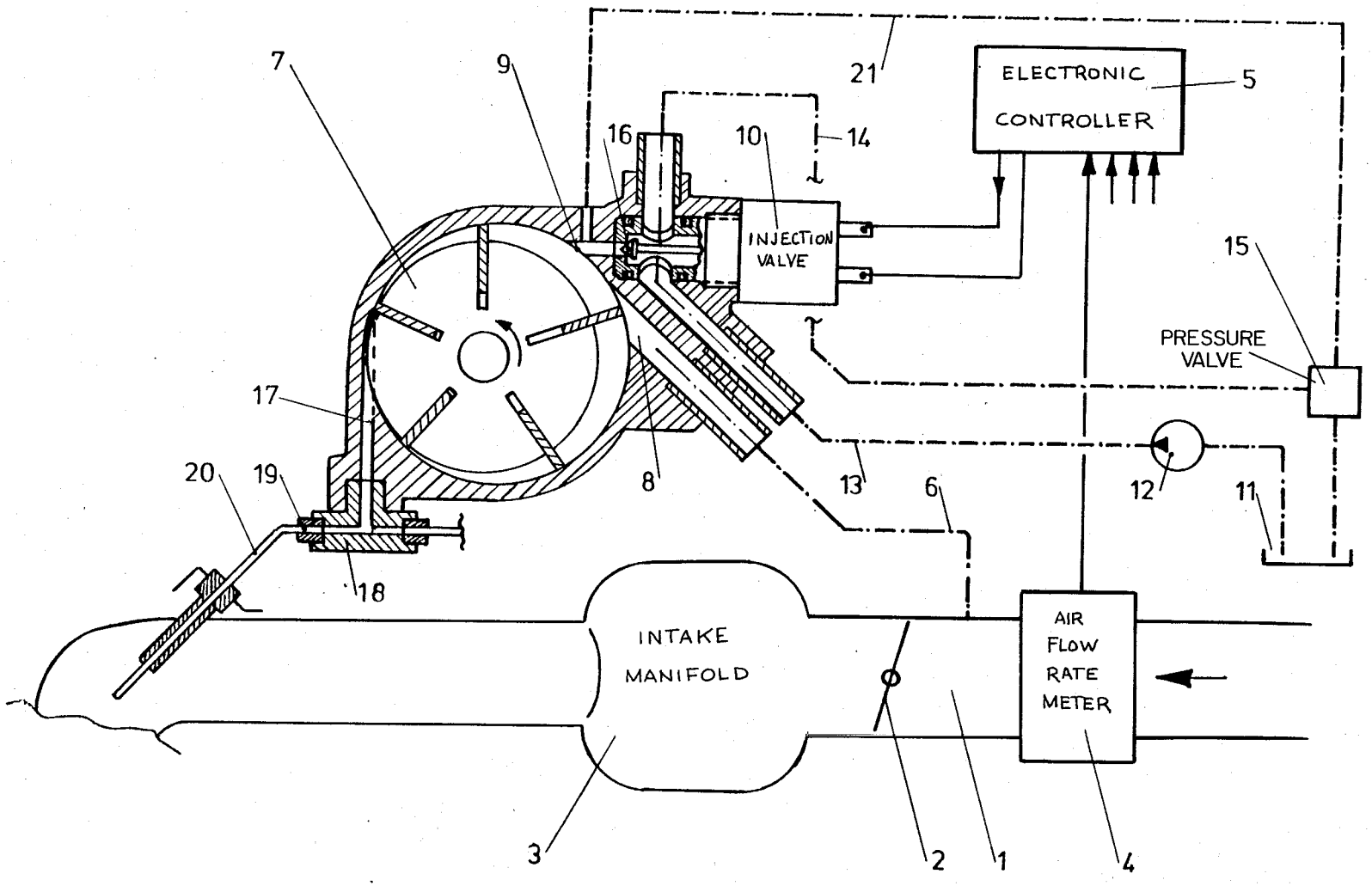
ELECTRONIC CONTROLLER
5
PRESSURE VALVE
15
11
12
AIR FLOW RATE METER
4
1
2
6
13
21
14
INJECTION VALVE
10
16
9
8
INTAKE MANIFOLD
3
7
17
18
19
20

FUEL SUPPLY ASSEMBLY FOR MIXTURE-COMPRESSING INTERNAL COMBUSTION ENGINES AND ASSOCIATED METHODS OF OPERATION

FIELD OF THE INVENTION

The present invention relates to a fuel supply assembly for a gasoline internal combustion engine having a branch air duct which extends from the intake duct upstream of the throttle valve and a pump which conveys the tapped quantity of air in the branch duct with a quantity of fuel supplied by an injection valve as a function of operating parameters, to distributing ducts extending downstream of said pump and leading to an associated intake connection in front of the inlet valves of the engine.

The invention also relates to associated methods of supply of fuel and air to the internal combustion engine.

PRIOR ART

A fuel supply assembly is known from West German Application OS No. 29 00 459. In such an assembly it is possible to use a single fuel-metering system which supplies, both at idling and under all other conditions of load of the engine, a quantity of fuel adapted to the condition of operation at the time. In the known assembly, the mouth of the injection nozzle of the fuel-metering system opens into the branch air duct upstream of the pump. The purpose of this is to have the supply of the fuel, during idle and at low load, to be controlled essentially by variation of the time during which the injection valve is open, while under higher load up to full load, when the injection valve is completely open, the supply of the fuel is effected substantially in response to the change of pressure in the branch air duct.

This construction of the assembly has the disadvantage that as a result of pulsation wirhin the branch air duct, part of the fuel may be held back as a film on the wall of the branch air duct. In this way, the air-fuel mixture supplied to the engine is too lean causing hesitation in engine operation whereas during deceleration of the engine, the mixture becomes enriched. Such enriching produces improper combustion and undesired exhaust gas quality. There is furthermore the danger that, due to the air pulsations in the branch air duct, the film of fuel will enter the intake duct, which has comparable results as regards improper combustion and undesired exhaust gas quality.

SUMMARY OF THE INVENTION

An object of the invention is to provide a fuel supply assembly which avoids the adverse effects of pulsations in the conventional assembly.

In order to satisfy the above and further objects of the invention, the fuel supply assembly is constructed to feed the air and fuel separately into the pump so that mixture of the fuel and air takes place for the first time in the pump chamber. In this way, the air and fuel are separately fed to the pump by which a rapid feeding can be obtained with the result that no fuel can flow in the branch air duct.

The invention is particularly directed to an improvement in a fuel supply assembly for an internal combustion engine of the type having an air intake duct with a throttle valve therein and wherein a branch air duct branches off from the intake duct upstream of the throttle valve. An injection valve supplies fuel to the chamber of a pump in an amount as a function of operating parameters. The pump conveys the air in the branch duct and the fuel injected by the injection valve as an air-fuel mixture to to the inlet valve of the engine. The improvement according to the invention contemplates that the injection valve opens directly into a fuel supply port which, in turn, opens directly into the chamber of the pump.

In accordance with a feature of the invention, the air branch duct and the fuel port fed by the injection valve open into the chamber of the pump in an arrangement wherein the fuel port is downstream of the branch duct.

In further accordance with the invention, the fuel port and branch duct both extend tangentially into the pump chamber in direction of conveyance of the air fuel mixture i.e. in the direction of rotation of the vanes of the pump.

In further accordance with the invention, a fuel circuit is established for supplying fuel to the pump in accordance with the operation of the injection valve and the fuel circuit includes a return line in which is contained a pressure valve subject to the pressure of the fuel fed to the pump.

A further object of the invention is to provide a method for supplying air-fuel mixture to an internal combustion engine which is characterized by separate feed of the fuel and air to the pump so that they first undergo mixture in the chamber of the pump.

In accordance with the method of the invention, fuel and air are separately discharged into the chamber of the pump, the fuel being controlled by an injection valve while the air is fed in a branch duct which is completely isolated from the fuel supply to the pump.

In further accordance with the method of the invention, the fuel and air are discharged tangentially into the chamber of the pump and the fuel is discharged downstream of the air.

BRIEF DESCRIPTION OF THE DRAWING

One embodiment of the invention is shown diagrammatically, by way of example, in the sole FIGURE of the drawing and will be described in further detail below.

DETAILED DESCRIPTION

Combustion air drawn in by an internal combustion engine (not shown) flows in the direction indicated by the arrow through the intake duct 1, past a throttle valve 2, and through an intake manifold 3 to the engine. Upstream of the throttle valve 2 is a meter 4 which measures rate of air-mass flow and which may be constructed as a conventional hot-wire air mass meter. An output signal of the air mass meter 4 is fed to an electronic controller 5, which is supplied with further operating parameters x,y,z which may also represent external parameters. The electronic controller 5 is a conventional central processing unit employing a microprocessor whose utilization is well known in the art. Upstream of the throttle valve 2 a branch air duct 6 extends from the intake duct 1 and leads to the inlet side of a pump 7 which is constructed as a vane pump. The inlet side of the pump comprises an air inlet 8 which enters the annular chamber of the pump 7 substantially tangentially. Within the pump 7, downstream of the air inlet 8, is a fuel inlet port 9, also arranged tangentially, into which fuel is fed by a magnetically actuated injection valve 10. The time of opening of the electromagnetically actuated injection valve 10 is controlled by the electronic controller 5 as a function of the operating parameters, such as, for instance, the composition of the exhaust gas, or as a function of external parameters, such as type of fuel, temperature of the air, and pressure of the air. The injection valve 10 is supplied with fuel from a fuel tank 11 by a fuel pump 12 and conduit 13, the fuel being at a low operating pressure of, for example, 0.5 bar. A tank return line 14 conveys excess fuel back to the tank 11 via a pressure valve 15. The pressure valve 15 maintains a predetermined system pressure within the circuit formed by conduit 13 and line 14 so that the amount of fuel discharged at the injection valve 10 through an injection nozzle 16 can be exactly determined. The pressure valve 15 can also be subject to the pressure prevailing in the fuel inlet port 9 via a line 21, as a result of which the system pressure always produces a constant differential pressure above that at the output of the injection valve 10.

By virtue of the separate inlet 8 of the branch air duct 6 and the fuel port 9 into the pump 7, pulsation in the branch air duct 6 is prevented from affecting the metering of the fuel. Furthermore, the separation has a result that no fuel film will precipitate within the branch air duct. This is also promoted by the fact that the position of the inlet port 9 is substantially tangential to the pump chamber and opens in the direction of conveyance of the fuel in the pump.

At its outlet side, the pump 7 has an outlet 17 which leads to a distributor 18 within which the air-fuel mixture is divided, in accordance with the number of cylinders, and fed to respective ports 19 leading to associated conduits 20 which in turn supply the air-fuel mixture to the intake manifold in front of the respective inlet valves of the internal combustion engine.

Although the invention has been described in accordance with a single embodiment thereof, it will become apparent to those skilled in the art that numerous modifications and variations can be made within the scope and spirit of the invention as defined in the attached claims.

What is claimed is:

1. In a fuel supply assembly for an internal combustion engine having an air intake duct with a throttle valve therein, a branch air duct branching off from the intake duct upstream of the throttle valve, means including an injection valve for supplying fuel in an amount as a function of operating parameters, a pump for conveying the air in the branch duct with the fuel injected by the injection valve as an air-fuel mixture to respective inlet valves of the cylinders of the engine, the improvement wherein said injection valve includes a fuel supply port which opens directly into said pump, said pump having an outlet connected to said air intake duct to supply air-fuel mixture to the inlet valves of the engine via said air intake duct such that each inlet valve receives air from the intake duct and air-fuel mixture from said pump.

2. The improvement as claimed in claim 1 wherein said pump has an inlet side into which the branch duct and the injection valve open, said injection valve opening into the pump downstream of the branch duct.

3. The improvement as claimed in claim 1 comprising electrical controller means coupled to the injection valve for operating the valve in response to operating parameters.

4. The improvement as claimed in claim 3 comprising a fuel feed means for said injection valve including a fuel tank, a fuel pump connected to said tank to supply fuel to the injection valve, and a fuel return line from said valve to said tank.

5. The improvement as claimed in claim 4 comprising a pressure valve in said fuel return line.

6. The improvement as claimed in claim 5 comprising means for establishing pressure at said pressure valve related to the pressure prevailing in the fuel inlet port of said pump.

7. The improvement as claimed in claim 2 comprising an air inlet conduit and a fuel inlet conduit opening tangentially into a chamber of said pump, said air inlet conduit and fuel inlet conduit being respectively connected to said branch duct and said injection valve.

8. A method of supplying air-fuel mixture to an internal combustion engine having an air intake duct with a throttle valve therein, said method comprising conveying air to the engine through the air intake duct under control of the throttle valve, supplying a portion of the air in said air intake duct to a pump via a branch line connected to said air intake duct upstream of the throttle valve, supplying fuel to said pump separately from the air such that the fuel and air first come into contact in the pump and are mixed therein and discharging the air-fuel mixture from the pump to the inlet valves of the engine via said air intake duct, the air in said intake duct being supplied to the inlet valves of the engine along with the air-fuel mixture.

9. A method as claimed in claim 8 wherein the pump has an annular pumping chamber and the fuel and air are each discharged tangentially into the chamber of the pump.

10. A method as claimed in claim 9 wherein the fuel is discharged into the chamber of the pump downstream of the air.

11. A method as claimed in claim 10 wherein the fuel and air are discharged in their direction of conveyance in the pump.

12. A method as claimed in claim 8 comprising controlling the fuel supply to the pump by an injection valve.

13. A method as claimed in claim 12 comprising electronically controlling the injection valve according to operating parameters of the engine.

14. A method as claimed in claim 12 comprising a fuel supply circuit for the injection valve and pressurizing a return line of said circuit according to the pressure prevailing in the fuel inlet port of the pump.

15. A method as claimed in claim 13 wherein one of the operating parameters is the air flow rate in the intake duct upstream of the throttle valve.

16. Apparatus as claimed in claim 1 wherein said pump comprises a vane pump having an annular pumping chamber into which said branch duct and said fuel supply port open at spaced locations at the periphery of said chamber.

* * * * *